United States Patent [19]

Stefanini

[11] Patent Number: 4,863,344

[45] Date of Patent: Sep. 5, 1989

[54] CENTRIFUGAL PUMP

[76] Inventor: Daniel Stefanini, Manor House, 27 Private Road, Sherwood, England

[21] Appl. No.: 197,091

[22] Filed: May 20, 1988

[30] Foreign Application Priority Data

May 22, 1987 [GB] United Kingdom ..... 8712187

[51] Int. Cl.[4] ..... F04D 29/22

[52] U.S. Cl. ..... 415/141; 415/152 A; 418/153

[58] Field of Search ..... 415/141, 152 A, 152 R; 418/153, 154 (U.S.); 416/132 R, 240 R

[56] References Cited

U.S. PATENT DOCUMENTS

| | | | |
|---|---|---|---|
| 1,116,851 | 11/1914 | Schneible | 415/141 |
| 1,313,203 | 8/1919 | Pakeman | 415/152 A X |
| 2,042,784 | 6/1936 | Harsel | 415/152 R X |
| 2,404,678 | 7/1946 | Wuensch | 415/141 X |
| 2,546,240 | 3/1951 | Squiers | 415/141 X |
| 2,933,046 | 4/1960 | McCray | 415/141 X |
| 3,080,824 | 3/1963 | Boyd et al. | 415/141 X |
| 3,510,229 | 5/1970 | Smith | 415/152 A X |
| 3,773,432 | 11/1973 | Chow et al. | 415/152 A |
| 4,392,779 | 7/1983 | Bloemers et al. | 415/141 |
| 4,600,361 | 7/1986 | Bianco | 415/152 A |

FOREIGN PATENT DOCUMENTS

| | | | |
|---|---|---|---|
| 0115005 | 8/1984 | European Pat. Off. . | |
| 0166104 | 1/1986 | European Pat. Off. . | |
| 326117 | 9/1920 | Fed. Rep. of Germany | 415/152 R |
| 1809054 | 6/1970 | Fed. Rep. of Germany | 415/152 A |
| 2124804 | 12/1972 | Fed. Rep. of Germany | 415/141 |
| 1047891 | 11/1966 | United Kingdom . | |
| 1223799 | 3/1971 | United Kingdom | 415/152 R |
| 1579493 | 11/1980 | United Kingdom . | |

*Primary Examiner*—Everette A. Powell, Jr.

*Attorney, Agent, or Firm*—Fuller, Puerner & Hohenfeldt

[57] ABSTRACT

A centrifugal pump comprises impeller blades which are pivoted at their inner ends to a rotor so that the impeller blades can rotate relatively thereto between two extreme positionss. The extreme positions are defined by stop means in the form of pins. The construction enables the centrifugal pump to be operated efficiently when driven in either direction, the blades being allowed to flex during operation.

8 Claims, 1 Drawing Sheet

CENTRIFUGAL PUMP

FIELD OF THE INVENTION

This invention relates to centrifugal pumps which may be used for pumping water or other fluids.

BACKGROUND OF THE INVENTION

Known centrifugal pumps comprise a rotor having impeller blades which is driven in rotation within a casing having an axial inlet for fluid and a peripheral outlet through which the fluid is discharged under the action of the rotor blades. Such pumps are generally designed to operate using only one direction of rotation of the rotor and the blades are shaped and angled to give an efficient pumping action when the rotor is driven in that direction. These pumps are usually very inefficient if the direction of rotation of the rotor is reversed, so that the blades are moving backwards.

In automatic underwater cleaners for swimming pools and the like, a submerged centrifugal pump is driven by an electric motor and is mounted on a device which is movable in more than one direction. Separate motors are provided for operating the pump and for driving the device in movement, the pump motor being operated in one direction only and the other motor being reversible so that the device can be moved in opposite directions as required.

The present invention is intended to provide a centrifugal pump which can operate efficiently when driven in either direction. Such a pump allows an automatic pool cleaner of the above-mentioned type to be driven by only one motor.

The blades of a centrifugal pump have to be set to particular orientations on the pump rotor to give an efficient pumping action. This orientation may vary according to the pressure against which the pump has to operate and according to the volume of fluid to be pumped. Also when designing a pump for a particular application, determining the optimum orientation of the impeller blades may be a troublesome and expensive operation.

The present invention is also intended to provide a centrifugal pump in which the blade orientation may readily be varied, and the optimum orientation easily determined.

SUMMARY OF THE INVENTION

According to one aspect of the invention, a reversible centrifugal pump comprises a rotor drivable in rotation in both directions about an axis by a motor, the rotor being mounted in a casing having an inlet and a peripheral outlet for fluid to be pumped, the rotor comprising impeller blades which are pivoted to the rotor to rotate relative thereto between two extreme positions, and stop means preventing rotation of the blades beyond said extreme positions.

The stop means may comprise pins extending through the rotor parallel to the rotor axis and positioned to abut the blades. Each blade may be associated with a pair of pins, the pins being a greater distance from the rotor axis than the blade pivots and the blades being between the pins so that the blades may rotate about their pivots between two extreme positions defined by the pins. Under the effect of the pressure of the fluid being pumped the blades will be urged against one pin or the other, depending on the direction of rotation of the rotor, and the pins may be located to give the optimum blade position in both directions of rotation.

The blades may be flexible so that they are capable of bending under the fluid pressure to further optimize the blade orientations during pumping. The blades may be of a flexible plastics material or of a metal such as stainless steel.

According to another aspect of the invention a centrifugal pump which may or may not be reversible comprises a rotor drivable in rotation about an axis, the rotor being mounted in a casing having an inlet and a peripheral outlet for fluid to be pumped, the rotor comprising impeller blades which are pivoted to the rotor to rotate relative thereto and stop means preventing rotation of the blades beyond an extreme position, the stop means being adaptable to vary said extreme position. In this pump the stop means may comprise pins inserted through holes provided in a pair of plates forming the sides of the rotor and a number of pairs of holes in the respective plates may be provided at different locations to define different extreme positions for the blades.

Varying the extreme position of the blades in this way allows the pump to be readily adapted to different pressures and rates of flow. It also allows the blades to be set to their optimum positions empirically, by running a series of tests with the blades in different positions. The blade position may be easily and quickly adjusted by removing the appropriate pins and re-inserting them at a different location. This arrangement may also be used for optimizing the performance of a pump at the design stage.

BRIEF DESCRIPTION OF THE DRAWINGS

A centrifugal pump according to one embodiment of the invention will now be described by way of example with reference to the accompanying drawings in which.

DESCRIPTION OF THE PREFERRED EMBODIMENT

Figure 1:
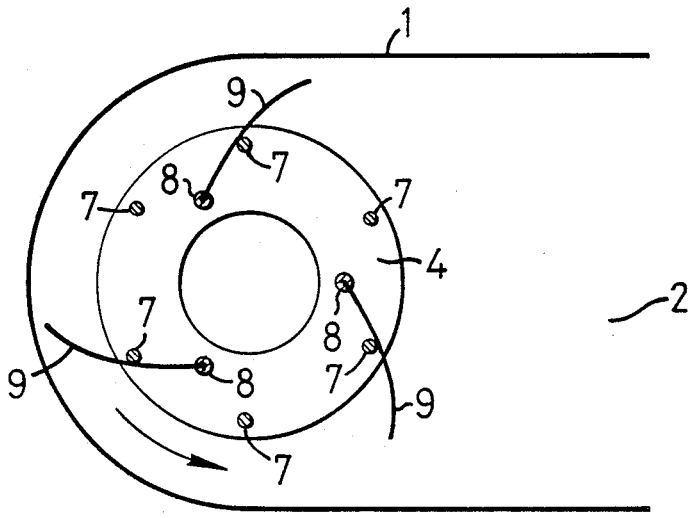
FIG. 1 is a schematic cross-section of a centrifugal pump.
Figure 2:
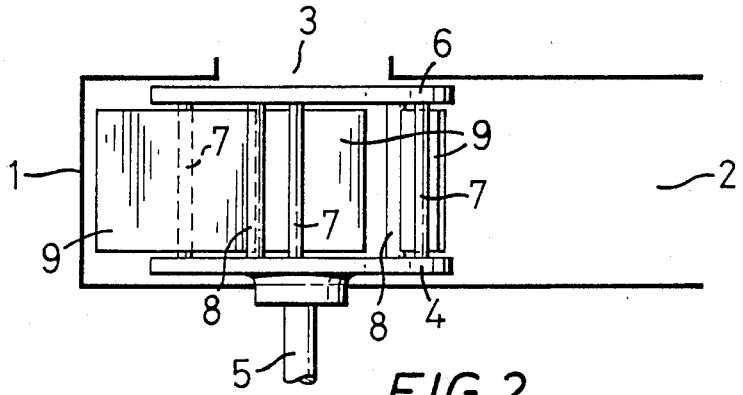
FIG. 2 is a schematic cross-section of the pump perpendicular to the section of FIG. 1.

The pump shown in the drawings comprises a casing 1 having one side 2 which is completely open, forming an outlet for discharge of fluid, and an opening 3 forming an inlet for fluid. The casing contains a rotor comprising a circular plate 4 which is drivable in rotation by means of shaft 5 driven by an electric motor (not shown in the drawings). The motor is capable of driving shaft 5 in either direction.

The rotor also comprises a circular plate 6 which is connected to plate 4 by pins 7 which extend parallel to the axis of shaft 5. In the embodiment shown in the drawings the pins are six in number and distributed around the periphery of the rotor discs.

The rotor also comprises spindles 8 which extend between the plates in the axial direction and impeller blades 9, three in number as shown in the drawings, which are pivoted for free rotation about the spindles 8. Pins 7 are further away from the axis of the rotor than spindles 8 so that the rotation of the blades about the spindles is limited by the pins abutting the blades. Pins 7 are positioned around the periphery of the rotor in pairs, one pair corresponding to each blade and the pins of each pair define a pair of extreme positions between which the blade can rotate relatively to the rotor about spindle 8.

The blades 9 are formed of sheets of flexible plastics material which in use can bend to a certain degree under fluid pressure. Alternatively, they may be formed of relatively thin stainless steel which is capable of bending in the same manner.

When the pump is in operation, fluid is fed to it through inlet 3 and the rotor is driven in rotation so that the blades 9 impel the fluid outwardly and the fluid is discharged through the open side 2 of the pump. FIG. 1 shows the rotor rotating in the anticlockwise direction and, against the resistance of the fluid, the blades move to the position shown in FIG. 1 in which they are held by abutment with pins 8. The positions of these pins are chosen so that the angles of the blades in this position are at an optimum for pumping efficiency, this optimum position may vary according to the speed of the rotor and the pressure head against which the fluid is pumped.

If the direction of rotation of the rotor is reversed the blades, under the effect of the fluid resistance, will move to their other extreme position defined by the other one of their pairs of pins, the blades then being angled in the reverse direction. The pins are located so that in this position also, the blades are positioned for optimum pumping efficiency. As the side 2 of the pump casing is completely open the fluid can escape in the same manner whatever the direction of rotation of the rotor.

The pump described is simple, requires little maintenance as it is well adapted to situations in which the motor driving it is required to operate in either direction, for example in underwater devices for cleaning swimming pools. The pump described allows a single motor to be used for pumping and for other operations, including to-and-fro movement, with such a device.

In another embodiment, not shown in the drawings, the pins are removable from plates 4 and 6 and for each pin a number of holes are provided in plates 4 and 6 to receive the pins so that each pin may be located at a choice of positions in the rotor. This feature allows the extreme positions of the impeller blades to be varied at will so that these positions may be set according to the pressure against which the pump has to operate, the volume of fluid to be pumped and the speed of rotation of the rotor. When the pump is installed at a given location, or when the pump is being designed for a given use, it may be operated in a series of trial runs with the pins in different positions and the pin position which gives the optimum efficiency may be adopted for subsequent use. This feature may also be used in centrifugal pumps which are intended to operate in one direction only, in which case the outlet for the fluid may be provided adjacent one side of the rotor only, instead of both sides as shown in the drawings.

I claim:

1. A centrifugal pump comprising a rotor for being driven rotatably about an axis in either direction by a motor, a casing in which the rotor is mounted, the casing having an axial inlet and a peripheral outlet for fluid to be pumped, the pump further comprising impeller blades each pivoted to the rotor on a pivot positioned radially outwardly of the axis of the rotor with the blade extending generally radially outwardly therefrom, and stop means positioned on the rotor relative to each blade to prevent rotation of the blade beyond two extreme positions one at either side of a radius of the rotor passing through the pivot, the blade in both extreme positions being disposed at the same angle relative to said radius for either direction of rotor rotation to pump fluid from the inlet through the outlet.

2. A pump according to claim 1, wherein said stop means comprise pins extending through the rotor parallel to the rotor axis and positioned to abut the blades.

3. A pump according to claim 2, wherein each blade is associated with a pair of said pins, these pins being a greater distance from the rotor axis than the blade pivots and the blades being between the pins so that the blades may rotate about their pivots between said two extreme positions defined by the pins.

4. A pump according to claim 1, wherein said blades are made of a flexible plastics material.

5. A pump according to claim 1, wherein said blades are made of flexible metal.

6. A pump according to claim 1 wherein the stop means are adapted to be moved on the rotor to vary said extreme positions.

7. A pump according to claim 1 wherein said rotor comprises a pair of plates forming the sides of the rotor, said plates having correspondingly positioned holes, and wherein said stop means comprise pins inserted through respective corresponding holes.

8. A pump according to claim 7, wherein a number of pairs of said holes in the respective plates are provided at different locations to define different extreme positions for the blades.

* * * * *